United States Patent [19]

Larson et al.

[11] Patent Number: 4,877,148

[45] Date of Patent: Oct. 31, 1989

[54] DISPENSING STRAW FOR LIQUID CONTAINER

[76] Inventors: Gordon Larson, 1780 Pass Rd.; John Pates, 193 Miramar, both of Biloxi, Miss. 39531

[21] Appl. No.: 272,435

[22] Filed: Nov. 17, 1988

[51] Int. Cl.[4] ..... A47G 19/22

[52] U.S. Cl. ..... 220/90.2; 215/1 A; 229/103.1

[58] Field of Search ..... 215/1 A; 220/90.2, 90.4; 229/103.1

[56] References Cited

U.S. PATENT DOCUMENTS

| | | | |
|---|---|---|---|
| 3,226,001 | 12/1965 | Sequeira | 215/1 A X |
| 3,291,331 | 12/1966 | Grisham et al. | 215/1 A |
| 3,558,033 | 1/1971 | Leeds | 220/90.2 X |
| 3,568,870 | 3/1971 | Elston | 215/1 A |
| 4,109,817 | 8/1979 | Payne et al. | 220/90.2 |
| 4,228,913 | 10/1980 | Mack et al. | 215/1 A X |
| 4,356,927 | 11/1982 | Cooper et al. | 220/90.2 |
| 4,537,324 | 8/1985 | Wang | 215/1 A X |
| 4,690,294 | 9/1987 | Jones | 220/90.2 |
| 4,728,001 | 3/1988 | Serba | 220/90.2 |
| 4,762,229 | 8/1988 | Wickre | 220/90.2 X |

FOREIGN PATENT DOCUMENTS

| | | | |
|---|---|---|---|
| 2250123 | 4/1974 | Fed. Rep. of Germany | 215/1 A |

*Primary Examiner*—Gerald A. Michalsky
*Attorney, Agent, or Firm*—Larson and Taylor

[57] ABSTRACT

A straw assembly is provided for a liquid container having a push tab or pull tab closure in a metallic container or a screw type closure on a plastic container. The straw is retained within the container in a retracted position even following opening of the removable closure. The straw is moved to an operative position by depressing a portion of the container so as to shift the straw laterally and permit the straw to emerge through the dispensing opening by means of a buoyancy collar on the straw.

12 Claims, 2 Drawing Sheets

FIG. 1
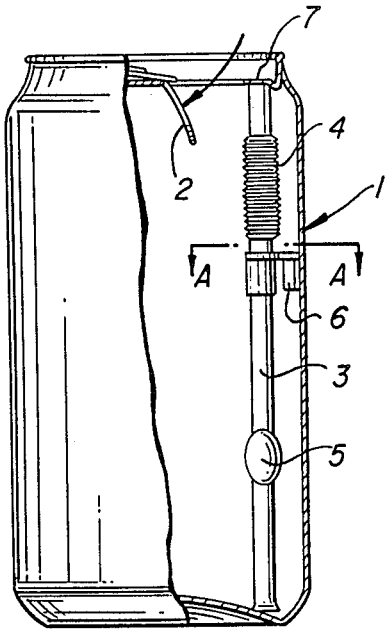
FIG. 2
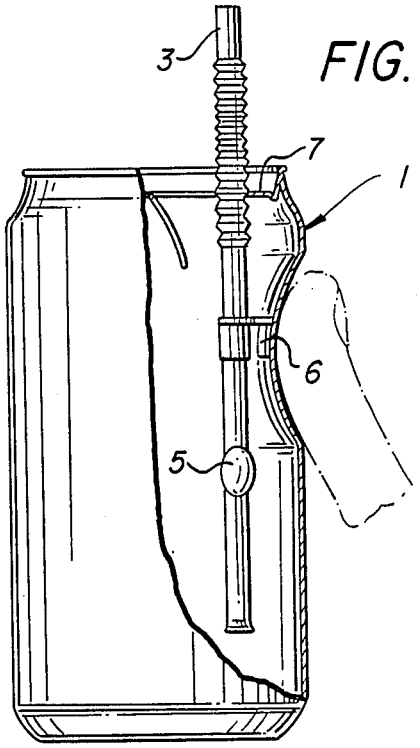
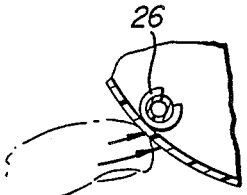
FIG. 3A
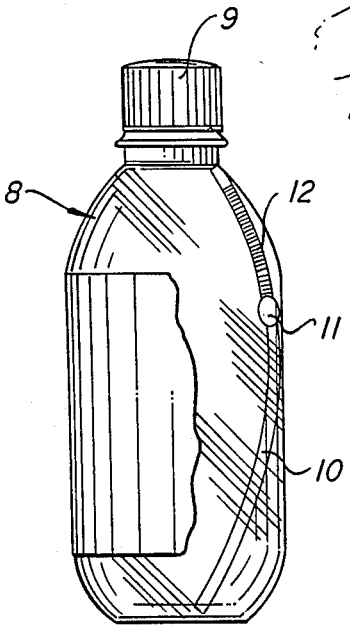
FIG. 3
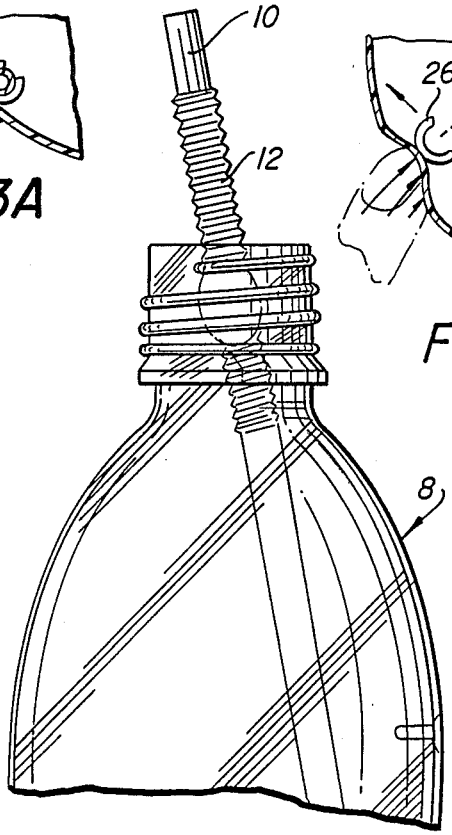
FIG. 4
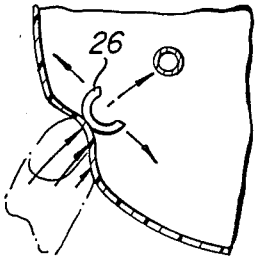
FIG. 3B

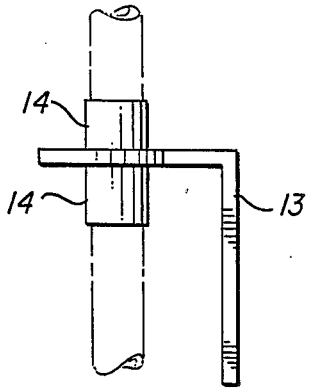
FIG. 5
FIG. 6
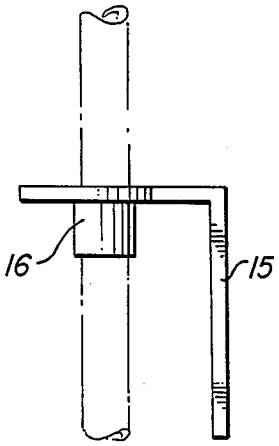
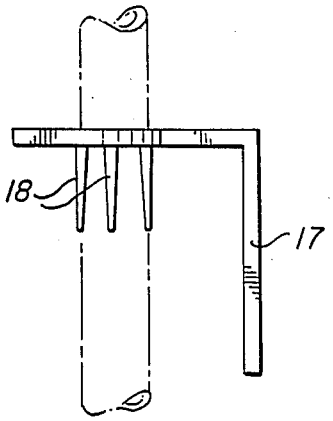
FIG. 7
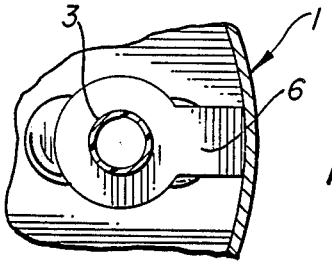
FIG. 8
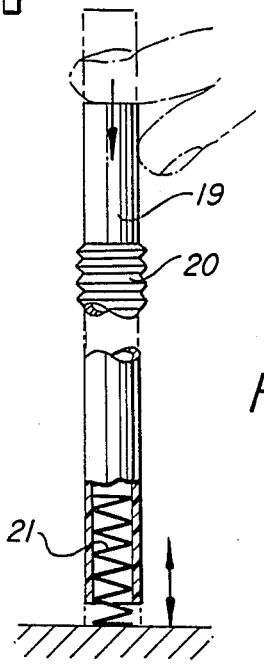
FIG. 9
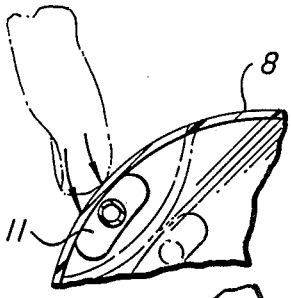
FIG. 10
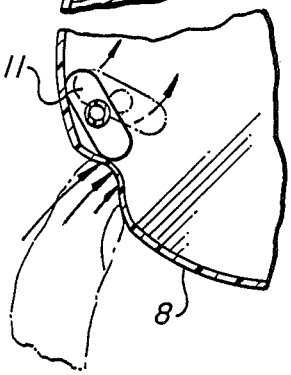
FIG. 11
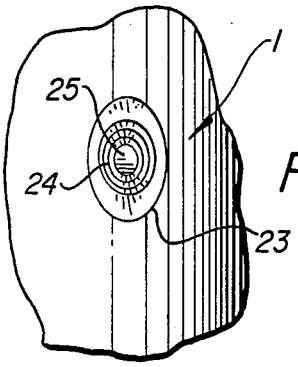
FIG. 12

DISPENSING STRAW FOR LIQUID CONTAINER

BACKGROUND OF THE INVENTION

The invention relates to liquid containers and more specifically to metallic liquid containers having push tab or pull tab closures or plastic containers having screw type removable closures and in which there is provided a straw assembly mounted within the container which may be either retained in a stored position or moved to an operative position.

PRIOR ART

U.S. Pat. No. 4,109,817 issued Aug. 29, 1978, discloses a straw assembly for a liquid container for containers having a pull type removable closure. In this prior art assembly, a straw is mounted within the container, the straw having a buoyancy device mounted thereon and, when the removable closure is pulled up, the straw which is positioned beneath the opening passes upwardly through the opening into an operative position. Currently, the vast majority of metal liquid containers are provided with push tab closures in which the closure is forced downwardly into the can in order to open the can. Obviously, the structure disclosed in U.S. Pat. No. 4,109,817 cannot be used with such a push type closure. Another disadvantage of the structures shown in U.S. Pat. No. 4,109,817 is that the straw retained within the container emerges from the container when the closure is removed irrespective of whether the user wishes to use a straw or drink directly from the can or pour the contents of the can directly into a glass.

SUMMARY OF THE INVENTION

The present invention provides a straw assembly for a push top closure and a pull top closure of a metallic container as well as a straw assembly for a screw top closure. According to the present invention, the straw will remain in an inoperative position within the container even after the closure has been removed. Thus, the user has the option of either activating the straw or pouring the contents of the container out without use of a straw. If activated, the straw can be replaced into its original position and the liquid either poured or drunk from the container opening.

The straw assembly, according to the present invention, provides a means for retaining the straw entirely within the confines of the can and out of alignment with the opening in the can even after the closure has been removed. In the case of containers having pull tab or push tab closures, the straw is positioned within the container beneath a lip on the can top which extends from the side wall outwardly to the periphery of the dispensing opening. When the closure is removed, if the user wishes to consume the liquid contents through a straw, the side of the can is depressed to force the straw outwardly from under the lip into the dispensing opening. In the case of a liquid container having a removable screw cap, the straw is retained against the interior of the container by means of a plastic c-clamp bracket or adhesive. By depressing the side of the bottle at the point where the adhesive or c-clamp bracket is located, the adhesive is released or the c-clamp is spread when the user wishes to utilize a straw.

Thus, the present invention overcomes the disadvantages of the prior art straw assemblies described hereinbefore by positioning the straw within the container so that it does not interfere with the opening of a push tab closure and by providing means for retaining the straw in an inoperative position unless use of the straw is desired in which case the side of the can may be depressed to release the straw to an operative position.

An object of the present invention is to provide a straw assembly which is operative with containers having a push tab, pull tab or screw type closure.

Another object of the present invention is to provide a straw assembly for a liquid container in which the straw is retained in an inoperative position within the container unless the user specifically wishes to drink through a straw.

Other objects and many of the intended advantages of the present invention will become more readily apparent when considered in connection with the accompanying drawings wherein:

BRIEF DESCRIPTION OF THE DRAWINGS

FIG. 1 is an elevational view partly in section showing the straw assembly according to the present invention used with a container having a push tab closure, FIG. 2 is an elevational view partly in section showing the straw assembly of FIG. 1 wherein the straw assembly is activated for use, FIG. 3 discloses a straw assembly according to the present invention in a plastic container having a screw type closure, FIG. 3A discloses in cross section a modified retaining means for a straw, FIG. 3B discloses the retaining means of FIG. 3A with the straw released, FIG. 4 shows the straw assembly of FIG. 3 activated for use, FIGS. 5, 6 and 7 disclose three different embodiments of a bracket for retaining a straw, FIG. 8 shows a cross sectional view of the straw assembly along the lines A—A of FIG. 1, FIG. 9 is an elevational view partly in section showing a spring incorporated in a straw, FIGS. 10 and 11 disclose the steps for releasing the straw assembly shown in FIG. 3 to operative position and, FIG. 12 discloses the activating means for the straw assembly shown in FIG. 1.

DESCRIPTION OF THE PREFERRED EMBODIMENTS

Referring now more specifically to the drawings wherein like numerals indicate like parts throughout the several views, there is shown in FIG. 1 at 1 a metallic container having a top wall, bottom wall and integral side wall. A push tab closure member is shown at 2. The straw assembly comprises a straw 3 having an accordion pleated portion 4 for elongating the straw or for bending the straw to any desired angle. There is further provided a buoyancy collar 5 on the lower portion of the straw. This buoyancy collar may be formed as either a plastic bubble which is blown from the body of the plastic straw, or a buoyant material affixed to the straw. A bracket 6 is mounted on the interior side wall of the container 1 and the bracket has an opening therein to slidably receive the straw 3. The bracket is located and dimensioned so that the upper end of the straw is disposed directly beneath a lip portion 7 of the top wall of the container. The lip 7 extends from the side wall of the container to the periphery of the dispensing opening formed when the push tab closure 2 is in an open position.

When it is desired to release the straw to an operative position, the side of the can is depressed as shown in FIG. 2 so as to force the bracket 6 and the straw 3 held within the bracket inwardly. Thus, the upper end of the straw is released from its inoperative position beneath the lip 7. The buoyancy collar 5 causes the straw to rise and emerge through the dispensing opening. Indicia or appropriate markings are provided on the external surface of the container to indicate where the can should be depressed to release the straw. Alternatively as shown in FIG. 12, a portion of the can can be formed with a circular section 23 having accordion pleats 24 therein to form a push button area 25 so that the bracket and straw assembly may be moved inwardly more readily.

In FIG. 3 there is shown a plastic beverage container 8 having a removable screw type cap 9 thereon. A plastic straw 10 having a buoyancy collar 11 thereon and accordion pleated section 12 is bent so as to fit within the container 8 without blocking the dispensing opening at the upper end of the container. The straw is retained in an inoperative position within the container by means of adhesive (not shown) which is applied to the buoyancy collar 11 and secures the straw to the inside wall. When it is desired to release the straw from its inoperative position the outside of the plastic container is depressed as shown in FIGS. 10 and 11 so as to release the adhesive binding the buoyancy collar 11 to the inside of the container. The outside wall of the plastic beverage container is provided with indicia or the like to indicate at what point finger pressure should be applied to release the straw. Alternatively, the inner surface of the beverage container may have a plastic c-clamp 26 affixed thereto as shown in FIG. 3A. When it is desired to release the straw, the outside of the container is depressed as shown in FIG. 3B so as to open the c-clamp.

In FIGS. 5, 6 and 7, there are shown different embodiments of the bracket to be used in place of the bracket shown in FIG. 1. In FIG. 5, a bracket 13 is shown having a collar 14 which extends both above and below the outwardly extending arm of bracket 13. The collar 14 ensures that the straw sliding within the collar will maintain a vertical alignment. FIGS. 6 discloses a bracket 15 having a collar 16 extending below the outwardly extending arm of the bracket. FIG. 7 discloses a bracket 17 having metal tabs 18 which are formed from the metal pushed out of the hole in the arm of bracket 17.

FIG. 9 discloses an alternative means for lifting the straw from its inoperative to operative position. A straw 19 having accordion pleats 20 therein, has a spring like mechanism 21 disposed in the lower end of the straw. The spring like member 21 is formed of plastic line which is coiled similar to a coil spring. The spring member 21 will retain the straw shown in FIG. 1 beneath the lip 7 and when the container is pushed inwardly as shown in FIG. 2 to release the straw from beneath the lip to the spring 21 will force the straw upwardly to an operative position.

Obviously, many modifications and variations of the present invention are possible in light of the above teachings. What is claimed as new and desired to be secured by Letters Patent is:

1. A straw assembly for a liquid container having a top wall, bottom wall and side wall with an openable closure for the dispensing opening of the container in the top wall including a straw disposed in said container, means for retaining the straw attached to the side wall of the container in the same position completely within the container with the openable closure in place closing the container or with the container open and means for causing the straw to be released to emerge through the dispensing opening when the closure is opened by depressing a portion of the external surface of the container.

2. A straw assembly according to Claim 1 wherein said retaining means includes adhesive attaching the straw to the interior surface of the side wall of the container.

3. A straw assembly according to Claim 1 wherein said retaining means includes a c-clamp attaching the straw to the interior surface of the side wall of the container.

4. A straw assembly according to Claim 1 wherein said retaining means includes a lip in the top wall extending from the side wall of the container to the periphery of the dispensing opening.

5. A straw assembly according to claim 1 and further including a buoyancy collar on the straw.

6. A straw assembly according to claim 1 and further including an accordion portion on the straw for elongating the straw.

7. A straw assembly for a liquid container having a top wall, bottom wall and side wall with a closure in the top wall with the outer peripheral edge of the closure being spaced from the periphery of the top wall to provide a lip portion in the top wall when the closure is opened, the straw assembly including bracket means on the interior surface of the side wall of the container, a straw slidably disposed in said bracket means, said bracket means being so located and dimensional to position the upper end of the straw beneath the lip portion of the top wall of the container so that when the closure of the container is opened the straw does not rise in the liquid, and indicator means on the container to indicate an area of the container to be depressed so as to move the straw to a position beneath the opening in the top wall of the container formed by removal of the closure so that the straw rises in the liquid within the container through the opening.

8. A straw assembly according to claim 7 wherein said straw includes an accordion portion for elongating the straw.

9. A straw assembly according to claim 7 and further including a sleeve on said bracket means within which the straw slides when moving between retracted and operable positions.

10. A straw assembly according to claim 7 and further including spring means mounted on the lower end of the straw to urge the straw upwardly within the container.

11. A straw assembly according to claim 7 and further including a buoyant ring on said straw disposed below said bracket means.

12. A method of providing a straw for dispensing liquid within a container having an openable closure comprising the steps of disposing a straw within a container in an inoperative position, retaining the straw in engagement with the side wall, opening the openable closure on the container while maintaining the straw in an inoperative position and activating the straw to move to an operative position by depressing a portion of the external surface of the container.

* * * * *